US011365925B2

(12) United States Patent
Scalf

(10) Patent No.: US 11,365,925 B2
(45) **Date of Patent: *Jun. 21, 2022**

(54) REFRIGERATOR WITH DOOR-MOUNTED ICEMAKING SYSTEM

(71) Applicant: Midea Group Co., Ltd., Foshan (CN)

(72) Inventor: Eric Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 3 days.

This patent is subject to a terminal disclaimer.

(21) Appl. No.: 16/983,479

(22) Filed: Aug. 3, 2020

(65) Prior Publication Data

US 2020/0363114 A1 Nov. 19, 2020

Related U.S. Application Data

(63) Continuation of application No. 15/830,845, filed on Dec. 4, 2017, now Pat. No. 10,731,909.

(51) Int. Cl.
*F25D 11/02* (2006.01)
*F25D 23/04* (2006.01)
(Continued)

(52) U.S. Cl.
CPC ..... *F25C 5/10* (2013.01); *F25B 5/02* (2013.01); *F25B 47/025* (2013.01); *F25C 1/24* (2013.01);
(Continued)

(58) Field of Classification Search
CPC .... F25B 5/02; F25C 1/24; F25C 5/182; F25C 5/185; F25C 5/22; F25C 2600/04;
(Continued)

(56) References Cited

U.S. PATENT DOCUMENTS 3,779,029 A 12/1973 Larriva
3,788,089 A 1/1974 Graves
(Continued)

FOREIGN PATENT DOCUMENTS

CN 201417059 Y 3/2010
CN 201954883 U 8/2011
(Continued)

OTHER PUBLICATIONS

International Search Report and Written Opinion issued in Application No. PCT/CN2018/074178 dated Aug. 13, 2018.
(Continued)

*Primary Examiner* — Miguel A Diaz
(74) *Attorney, Agent, or Firm* — Middleton Reutlinger

(57) ABSTRACT

A refrigerator and method utilize a door-mounted icemaking system including an icemaking mold, an ice storage bin and a cold wall evaporator disposed proximate the ice storage bin along an interior wall of the door to provide cooling proximate the ice storage bin. In some instances, the cold wall evaporator may be in addition to an icemaking evaporator that provides direct cooling of the icemaking mold, and furthermore, in some instances, the cold wall and icemaking evaporators may be separately controllable to optimize cooling within the door-mounted icemaking system. In addition, in some instances, a hot wall condenser may be used in a door-mounted icemaking system to dissipate heat generated by a refrigeration circuit through an exterior wall of a door. Further, in some instances a reversible refrigeration circuit may be used in connection with an icemaking evaporator to assist in ejecting ice from an icemaking mold.

18 Claims, 6 Drawing Sheets

(51) Int. Cl.

| | |
|---|---|
| ***F25C 1/24*** | (2018.01) |
| ***F25C 5/182*** | (2018.01) |
| ***F25D 29/00*** | (2006.01) |
| ***F25D 23/00*** | (2006.01) |
| ***F25B 5/02*** | (2006.01) |
| ***F25C 5/185*** | (2018.01) |
| ***F25C 5/20*** | (2018.01) |
| ***F25C 5/10*** | (2006.01) |
| ***F25B 47/02*** | (2006.01) |
| ***F25D 19/04*** | (2006.01) |

(52) U.S. Cl.
CPC ..... *F25C 5/182* (2013.01); *F25C 5/185* (2013.01); *F25D 11/022* (2013.01); *F25D 19/04* (2013.01); *F25D 23/006* (2013.01); *F25D 23/04* (2013.01); *F25D 29/005* (2013.01); *F25B 2600/2511* (2013.01); *F25C 5/22* (2018.01); *F25C 2600/04* (2013.01)

(58) Field of Classification Search
CPC ..... F25D 11/022; F25D 23/006; F25D 23/02; F25D 23/028; F25D 23/04; F25D 29/005
See application file for complete search history.

(56) References Cited

U.S. PATENT DOCUMENTS

| | | | | |
|---|---|---|---|---|
| 3,902,332 | A | 9/1975 | Torcomian | |
| 5,218,830 | A | 6/1993 | Martineau | |
| 6,945,068 | B2 | 9/2005 | Kim et al. | |
| 6,964,177 | B2 | 11/2005 | Lee et al. | |
| 7,614,244 | B2 | 11/2009 | Venkatakrishnan et al. | |
| 7,681,406 | B2 | 3/2010 | Cushman et al. | |
| 8,074,464 | B2 | 12/2011 | Venkatakrishnan et al. | |
| 9,021,828 | B2 | 5/2015 | Vitan et al. | |
| 9,097,454 | B2 | 8/2015 | LeClear et al. | |
| 9,115,924 | B2 | 8/2015 | Leclear et al. | |
| 9,297,571 | B1 | 3/2016 | Correa et al. | |
| 9,377,233 | B2 * | 6/2016 | Boehringer | F25C 1/24 |
| 9,523,526 | B2 | 12/2016 | Brunner et al. | |
| 9,534,821 | B2 | 1/2017 | Yoon et al. | |
| 9,593,870 | B2 * | 3/2017 | Boarman | F25C 5/185 |
| 10,247,462 | B2 | 4/2019 | Lee | |
| 10,539,354 | B2 * | 1/2020 | Shi | F25C 1/04 |
| 2009/0293508 | A1 | 12/2009 | Rafalovich et al. | |
| 2010/0326096 | A1 * | 12/2010 | Junge | F25C 1/00 62/82 |
| 2013/0000345 | A1 | 1/2013 | Vitan et al. | |
| 2013/0327076 | A1 | 12/2013 | Jeong et al. | |
| 2014/0150460 | A1 | 6/2014 | Boarman et al. | |
| 2014/0216095 | A1 | 8/2014 | Leclear et al. | |
| 2014/0260407 | A1 * | 9/2014 | Boehringer | F25C 1/24 62/344 |
| 2016/0178245 | A1 | 6/2016 | Choi | |
| 2016/0370050 | A1 | 12/2016 | Park | |
| 2016/0370062 | A1 | 12/2016 | Yang | |
| 2016/0370078 | A1 | 12/2016 | Koo | |
| 2017/0307273 | A1 | 10/2017 | Lee | |
| 2018/0245826 | A1 | 8/2018 | Jung et al. | |
| 2018/0347884 | A1 * | 12/2018 | Kang | F16K 31/0686 |
| 2019/0011163 | A1 | 1/2019 | Bertolini et al. | |
| 2019/0024962 | A1 | 1/2019 | Lee et al. | |
| 2019/0093938 | A1 | 3/2019 | Miller et al. | |
| 2019/0178561 | A1 * | 6/2019 | Marinello | F28F 1/20 |
| 2019/0195543 | A1 | 6/2019 | Shi et al. | |
| 2019/0264974 | A1 | 8/2019 | Mitchell et al. | |

FOREIGN PATENT DOCUMENTS

| | | | |
|---|---|---|---|
| CN | 105758100 | A | 7/2016 |
| CN | 106257209 | A | 12/2016 |
| KR | 20080015341 | A | 2/2008 |
| KR | 20090012689 | A | 2/2009 |
| KR | 20160051223 | A | 5/2016 |

OTHER PUBLICATIONS

Espindola, Rodolfo da Silva, et al. "Pros & Cons of Using Hot-Wall Condensers in Household Refrigerators" 2018, International Refrigeration and Air Conditioning Conference. Paper 1847, https://docs/lib/purdue.edu/iracc/1847.

Wa Wine Blog, Aug. 28, 2019, What's the Difference Between Forced-air and Cold-wall Wine Cooling Systems? Retrieved Mar. 26, 2020, from http://blog.iwawine.com/2012/06/le-cache-primer-whats-the-difference-between-forced-air-and-cold-wall-cooling-systems/, 2019.

* cited by examiner

REFRIGERATOR WITH DOOR-MOUNTED ICEMAKING SYSTEM

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. For many years, most refrigerators have fallen in to one of two categories. Top mount refrigerators, for example, include a freezer compartment near the top of the refrigerator, either accessible via a separate external door from the external door for the fresh food compartment, or accessible via an internal door within the fresh food compartment. Side-by-side refrigerators, on the other hand, orient the freezer and fresh food compartments next to one another and extending generally along most of the height of the refrigerator.

Door-mounted ice dispensers (which are often combined with water dispensers) are common convenience features on many of these residential refrigerators. Incorporating these features into top mount and side-by-side refrigerators has generally been straightforward because it is generally possible to mount such dispensers on the external door for the freezer compartment at a convenient height for a user, as well as at a location suitable for receiving ice produced by an icemaker mounted in the freezer compartment.

More recently, however, various types of bottom mount refrigerator designs have become more popular with consumers. Bottom mount refrigerators orient the freezer compartment below the fresh food compartment and near the bottom of the refrigerator. For most people, the fresh food compartment is accessed more frequently than the freezer compartment, so many of the items that a user accesses on a daily basis are accessible at a convenient height for the user. Some bottom mount refrigerators include a single door for each of the fresh food and freezer compartments, while other designs commonly referred to as "French door" refrigerators include a pair of side-by-side doors for the fresh food compartment. Some designs may also utilize sliding doors instead of hinged doors for the freezer compartment, and in some designs, multiple doors may be used for the freezer compartment.

Placing the freezer compartment at the bottom of a refrigerator, however, complicates the design of door-mounted ice dispensers, since every freezer compartment door is generally located too low for a door-mounted ice dispenser, and since placement of an ice dispenser on a fresh food compartment door orients the ice dispenser opposite the above-freezing fresh food compartment. Most ice dispensers rely at least in part on gravity to convey ice from an icemaker mold to a storage receptacle and/or to convey ice from the storage receptacle to an exit chute for the ice dispenser, so it is generally desirable to orient the icemaker at a higher elevation than the ice dispenser.

As a result, many designs have sought to locate the icemaker and storage receptacle in one or more separate sub-compartments either in a fresh food compartment door or in the fresh food compartment itself, and direct cool air from the freezer compartment to the sub-compartment(s) in order to maintain the icemaker and storage receptacle at a temperature suitable for producing and storing ice. Existing designs, however, are often fraught with compromises, leading to reduced energy efficiency, increased costs, reduced storage capacity, and complicated arrangements of ducts and ports.

Accordingly, a need continues to exist in the art for an improved manner of providing door-mounted ice dispensing, particularly within a bottom mount refrigerator.

SUMMARY

The herein-described embodiments address these and other problems associated with the art by providing in one aspect a refrigerator and method that utilize a door-mounted icemaking system including an icemaking mold, an ice storage bin and a cold wall evaporator disposed proximate the ice storage bin along an interior wall of the door to provide cooling proximate the ice storage bin. In some instances, the cold wall evaporator may be in addition to an icemaking evaporator that provides direct cooling of the icemaking mold, and furthermore, in some instances, the cold wall and icemaking evaporators may be separately controllable to optimize cooling within the door-mounted icemaking system. In addition, in some instances, a hot wall condenser may be used in a door-mounted icemaking system to dissipate heat generated by a refrigeration circuit through an exterior wall of a door. Further, in some instances a reversible refrigeration circuit may be used in connection with an icemaking evaporator to assist in ejecting ice from an icemaking mold.

Therefore, consistent with one aspect of the invention, a refrigerator may include a cabinet including a fresh food compartment and a freezer compartment, a fresh food compartment door coupled to the cabinet adjacent an opening of the fresh food compartment and configured to insulate the fresh food compartment from an exterior environment, and a door-mounted icemaking system disposed on the fresh food compartment door. The fresh food compartment door may include one or more interior walls facing the fresh food compartment when the door is closed and including one or more metal sheets, and an exterior wall facing the exterior environment and including an exterior metal skin. The door-mounted icemaking system may include an icemaking mold disposed between the exterior wall and the one or more interior walls of the fresh food compartment door and configured to produce ice, an ice storage bin disposed between the exterior wall and the one or more interior walls of the fresh food compartment door and configured to receive and store ice produced by the icemaking mold, an ice and water dispenser disposed on the exterior wall of the fresh food compartment door and configured to dispense water and to dispense ice produced by the icemaking mold, and a reversible self-contained in-door refrigeration circuit disposed between the exterior wall and the one or more interior walls of the fresh food compartment door. The reversible self-contained in-door refrigeration circuit may include a compressor in thermal contact with the exterior metal skin, a condenser in fluid communication with an outlet of the compressor and in thermal contact with the exterior metal skin, an icemaking evaporator disposed between the exterior wall and the one or more interior walls of the fresh food compartment door and in thermal contact with the icemaking mold to directly cool the icemaking mold, a cold wall evaporator disposed proximate the ice storage bin and along at least one interior wall among the one or more interior walls of the door, the cold wall evaporator in thermal contact with the one or more metal sheets, and at least one valve disposed between the condenser and one or both of the icemaking and cold wall evaporators to regulate refrigerant flow to one or both of the icemaking and cold wall evaporators. The refrigerator may also include a controller coupled to the reversible self-contained in-door refrigeration circuit and configured control the at least one valve to selectively control refrigerant flow to the cold wall evaporator and the icemaking evaporator. The controller may also be configured to control the compressor to selectively reverse refrigerant flow to the icemaking evaporator to heat the icemaking mold when ejecting ice from the icemaking mold.

Consistent with another aspect of the invention, a refrigerator may include a cabinet including one or more food storage compartments defined therein, a door coupled to the cabinet adjacent an opening of a first compartment from among the one or more food storage compartments and configured to insulate the first compartment from an exterior environment, the door including one or more interior walls facing the first compartment when the door is closed and an exterior wall facing the exterior environment, and a door-mounted icemaking system disposed on the door. The door-mounted icemaking system may include an icemaking mold disposed between the exterior wall and the one or more interior walls of the door and configured to produce ice, an ice storage bin disposed between the exterior wall and the one or more interior walls of the door and configured to receive and store ice produced by the icemaking mold, and a cold wall evaporator disposed proximate the ice storage bin and along at least one interior wall among the one or more interior walls of the door.

In some embodiments, the cold wall evaporator includes a generally planar evaporator coil disposed along at least a portion of a first interior wall among the one or more interior walls of the door. Also, in some embodiments, the first interior wall is a back-facing wall of the door. Also, in some embodiments, the cold wall evaporator extends along multiple interior walls among the one or more interior walls of the door, where the multiple interior walls include interior walls selected from the group consisting of a back-facing wall, a top-facing wall, a bottom-facing wall, and a side-facing wall.

Some embodiments may further include a thermally-conductive body disposed on the at least one interior wall, the thermally-conductive body formed of a heat conducting material and in thermal contact with the cold wall evaporator. Further, in some embodiments, the thermally-conductive body includes a metal sheet. In some embodiments, the metal sheet includes multiple portions disposed on multiple interior walls among the one or more interior walls of the door. In addition, in some embodiments, the thermally-conductive body includes multiple metal sheets disposed on multiple interior walls among the one or more interior walls of the door.

Some embodiments may also include an icemaking evaporator in thermal contact with the icemaking mold to directly cool the icemaking mold. In some embodiments, the icemaking evaporator is integrally formed with the icemaking mold. In some embodiments, the icemaking and cold wall evaporators are coupled in series. In addition, some embodiments may also include at least one valve disposed between a refrigerant supply and one or both of the icemaking and cold wall evaporators to regulate refrigerant flow to one or both of the icemaking and cold wall evaporators.

In addition, some embodiments may further include a controller coupled to the at least one valve, the controller configured to control the at least one valve to direct refrigerant flow only to the cold wall evaporator when the ice storage bin is full, and direct refrigerant flow only to the icemaking evaporator when maximizing ice production. In some embodiments, the door-mounted icemaking system further includes a reversible refrigeration circuit coupled to the icemaking evaporator, the reversible refrigeration circuit configured to cool the icemaking mold when operating in an ice producing mode and to heat the icemaking mold when operating in an ice ejecting mode.

Further, in some embodiments may, the door-mounted icemaking system further includes a condenser disposed between the exterior wall and the one or more interior walls of the door. Moreover, in some embodiments, the condenser includes a generally planar condenser coil extending along at least a portion of the exterior wall of the door. Some embodiments may also include a thermally-conductive body disposed in the exterior wall, the thermally-conductive body formed of a heat conducting material and in thermal contact with the condenser. In some embodiments, the thermally-conductive body includes an exterior metal skin of the door. In addition, some embodiments may also include a plurality of heat shunts extending between the condenser and the exterior metal skin of the door.

In addition, in some embodiments, the door-mounted icemaking system further includes a compressor disposed between the exterior wall and the one or more interior walls of the door and operatively coupled to the cold wall evaporator and the condenser in a self-contained in-door refrigeration circuit. Some embodiments may further include a thermally-conductive body disposed in the exterior wall of the door, the thermally-conductive body formed of a heat conducting material and in thermal contact with the condenser and the compressor.

In addition, some embodiments may further include an externally-accessible dispenser disposed on the door and configured to dispense ice produced by the icemaking mold.

Consistent with another aspect of the invention, a door-mounted icemaking system may be provided for a refrigerator of the type including a cabinet including one or more food storage compartments defined therein and a door coupled to the cabinet adjacent an opening of a first compartment from among the one or more food storage compartments and configured to insulate the first compartment from an exterior environment, the door including one or more interior walls facing the first compartment when the door is closed and an exterior wall facing the exterior environment. The door-mounted icemaking system may include an icemaking mold disposed between the exterior wall and the one or more interior walls of the door and configured to produce ice, an ice storage bin disposed between the exterior wall and the one or more interior walls of the door and configured to receive and store ice produced by the icemaking mold, an icemaking evaporator disposed between the exterior wall and the one or more interior walls of the door and in thermal contact with the icemaking mold to directly cool the icemaking mold, a cold wall evaporator disposed proximate the ice storage bin and along at least one interior wall among the one or more interior walls of the door, and at least one valve coupled between a refrigerant supply and one or both of the icemaking and cold wall evaporators and configured to regulate refrigerant flow to one or both of the icemaking and cold wall evaporators.

Some embodiments may also include a controller coupled to the at least one valve and configured to control the at least one valve to direct refrigerant flow only to the cold wall evaporator when the ice storage bin is full, and direct refrigerant flow only to the icemaking evaporator when maximizing ice production. In addition, in some embodiments, the icemaking evaporator and the cold wall evaporator are disposed in a reversible refrigeration circuit and the controller is further configured to selectively reverse the reversible refrigerator circuit to heat the icemaking mold when ejecting ice from the icemaking mold.

Consistent with another aspect of the invention, a method may be provided for operating a reversible refrigeration circuit of a door-mounted icemaking system for a refrigerator that includes an icemaking mold disposed between an exterior wall and one or more interior walls of a door of the refrigerator and an icemaking evaporator disposed between the exterior wall and the one or more interior walls of the fresh food compartment door and in thermal contact with the icemaking mold to directly cool the icemaking mold. The method may include operating the reversible refrigeration circuit to cool the icemaking mold with the icemaking evaporator when producing ice with the icemaking mold, and operating the reversible refrigeration circuit to heat the icemaking mold with the icemaking evaporator when ejecting ice from the icemaking mold.

Also, in some embodiments, the door-mounted icemaking system further includes an ice storage bin disposed between the exterior wall and the one or more interior walls of the door and configured to receive and store ice produced by the icemaking mold, a cold wall evaporator disposed proximate the ice storage bin and along at least one interior wall among the one or more interior walls of the door, and at least one valve coupled between a refrigerant supply and one or both of the icemaking and cold wall evaporators. In addition, the method may further include regulating refrigerant flow to one or both of the icemaking and cold wall evaporators using the at least one valve. In addition, some embodiments may further include controlling the at least one valve to direct refrigerant flow only to the cold wall evaporator when the ice storage bin is full, and controlling the at least one valve to direct refrigerant flow only to the icemaking evaporator when maximizing ice production.

Consistent with another aspect of the invention, a refrigerator may include a cabinet including one or more food storage compartments defined therein, a door coupled to the cabinet adjacent an opening of a first compartment from among the one or more food storage compartments and configured to insulate the first compartment from an exterior environment, the door including one or more interior walls facing the first compartment when the door is closed and an exterior wall facing the exterior environment, and a door-mounted icemaking system disposed on the door. The door-mounted icemaking system may include an icemaking mold disposed between the exterior wall and the one or more interior walls of the door and configured to produce ice, an ice storage bin disposed between the exterior wall and the one or more interior walls of the door and configured to receive and store ice produced by the icemaking mold, and a refrigeration circuit disposed on the door and including an evaporator disposed between the exterior wall and the one or more interior walls of the door and configured to provide cooling for the door-mounted icemaking system and a hot wall condenser disposed on the door and in fluid communication with the evaporator, where the hot wall condenser is configured to dissipate heat generated by the refrigeration circuit through the exterior wall of the door.

Further, in some embodiments, the condenser includes a generally planar condenser coil extending along at least a portion of the exterior wall of the door. In addition, some embodiments may also include a thermally-conductive body disposed in the exterior wall, the thermally-conductive body formed of a heat conducting material and in thermal contact with the condenser. Also, in some embodiments, the exterior wall of the door includes an exterior metal skin, and where the condenser is in thermal contact with the exterior metal skin of the door. Some embodiments may further include a plurality of heat shunts extending between the condenser and the exterior metal skin of the door.

Further, in some embodiments, the door-mounted icemaking system further includes a compressor disposed between the exterior wall and the one or more interior walls of the door and operatively coupled to the evaporator and the condenser in a self-contained in-door refrigeration circuit, and the refrigerator further includes a thermally-conductive body disposed in the exterior wall of the door, the thermally-conductive body formed of a heat conducting material and in thermal contact with the condenser and the compressor. In some embodiments, the evaporator includes a cold wall evaporator disposed proximate the ice storage bin and along at least one interior wall among the one or more interior walls of the door. Some embodiments may also include an icemaking evaporator in thermal contact with the icemaking mold to directly cool the icemaking mold.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
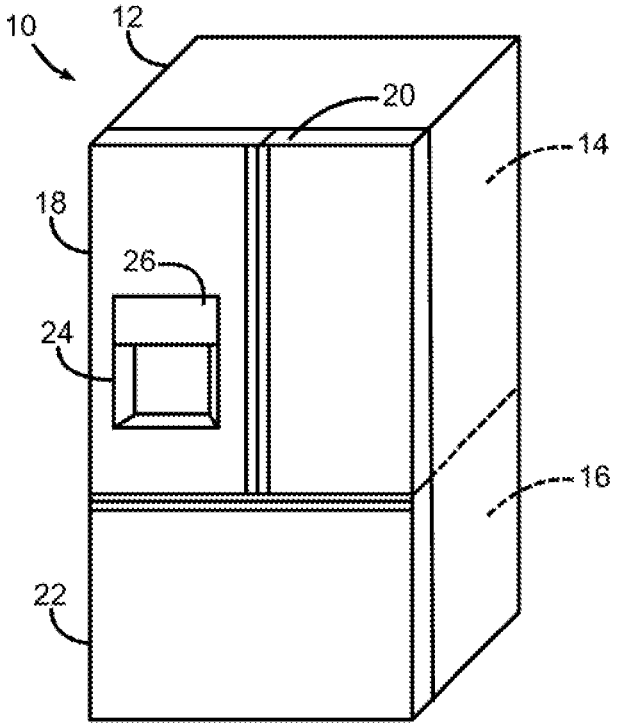
FIG. 1 is a perspective view of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12 including one or more food storage compartments (e.g., a fresh food compartment 14 and a freezer compartment 16), as well as one or more fresh food compartment doors 18, 20 and one or more freezer compartment doors 22 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, and includes a pair of side-by-side fresh food compartment doors 18, 20 that are hinged along the left and right sides of the refrigerator to provide a wide opening for accessing the fresh food compartment, as well as a single sliding freezer compartment door 22 that is similar to a drawer and that pulls out to provide access to items in the freezer compartment. It will be appreciated, however, that other door designs may be used in other embodiments, including various combinations and numbers of hinged and/or sliding doors for each of the fresh food and freezer compartments. Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments.

Refrigerator 10 also includes a door-mounted dispenser 24 for dispensing ice and/or water. In the illustrated embodiments, dispenser 24 is an ice and water dispenser capable of dispensing both ice (cubed and/or crushed) and chilled water, while in other embodiments, dispenser 24 may be an ice only dispenser for dispensing only cubed and/or crushed ice. In still other embodiments, dispenser 24 may additionally dispense hot water, coffee, beverages, or other liquids, and may have variable and/or fast dispense capabilities. In some instances, ice and water may be dispensed from the same location, while in other instances separate locations may be provided in the dispenser for dispensing ice and water.

Refrigerator 10 also includes a control panel 26, which in the illustrated embodiment is integrated with dispenser 24 on door 18, and which includes various input/output controls such as buttons, indicator lights, alphanumeric displays, dot matrix displays, touch-sensitive displays, etc. for interacting with a user. In other embodiments, control panel 26 may be separate from dispenser 24 (e.g., on a different door), and in other embodiments, multiple control panels may be provided. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Figure 2:
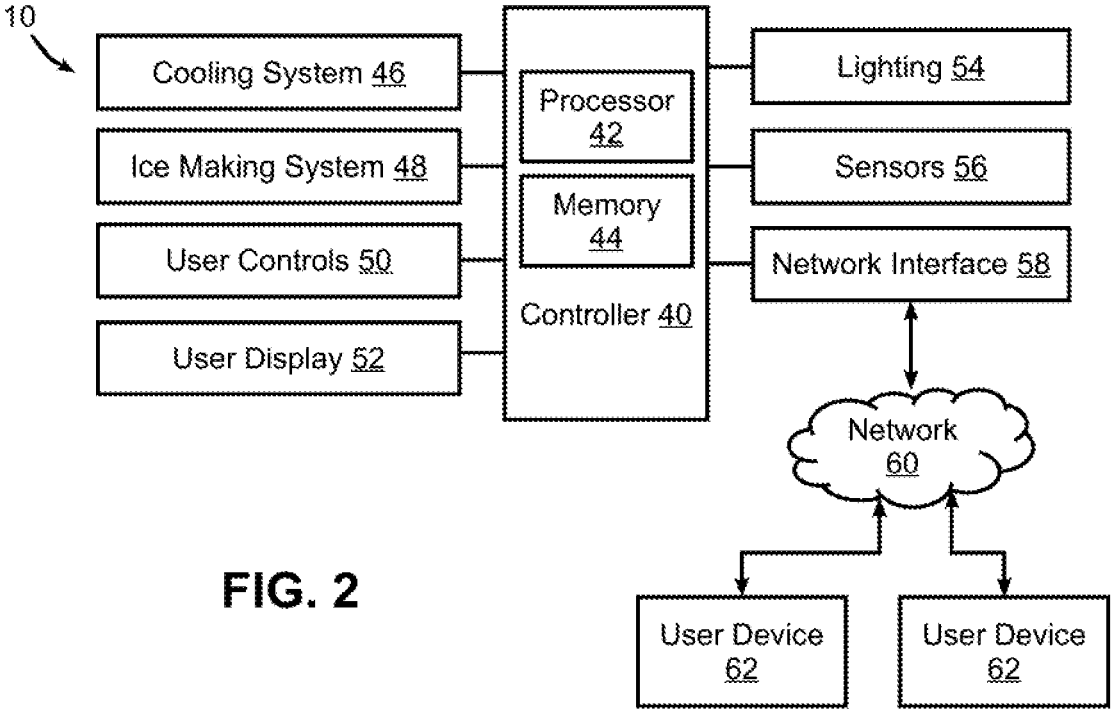
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40. Controller 40 may also be distributed among multiple controller circuits within refrigerator 12 in some embodiments, so the invention should not be considered to be limited to a controller implemented as a single central controller circuit as is illustrated in FIG. 2.

As shown in FIG. 2, controller 40 may be interfaced with various components, including a cooling or refrigeration system 46, an icemaking system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Figure 3:
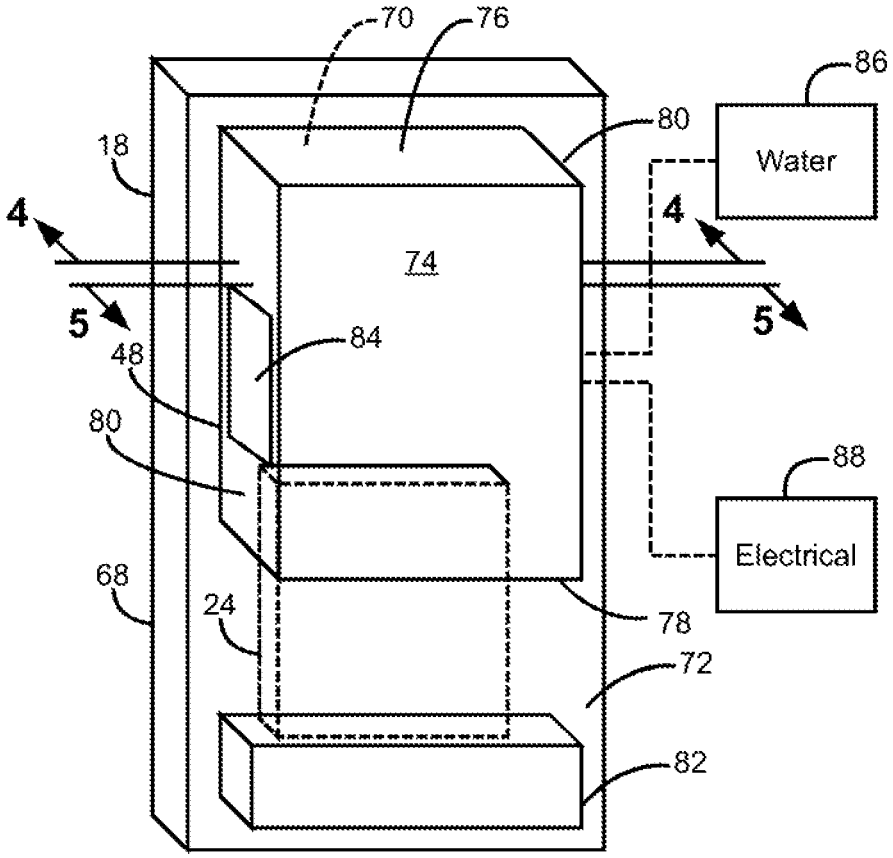
FIG. 3 is a functional perspective view of an interior side of a fresh food door of the refrigerator of FIG. 1.

Now turning to FIG. 3, embodiments consistent with the invention, as mentioned above, are directed in part to the use of a door-mounted icemaking system, e.g., door-mounted icemaking system 48 disposed on fresh food compartment door 18. Fresh food compartment door 18 includes an exterior wall 68 facing the exterior environment (and optionally including an ice and/or water dispenser 24), as well as an icemaking compartment 70 defined by one or more interior walls facing fresh food compartment 14 when door 18 is closed. In the illustrated embodiment, for example, a main back-facing interior wall 72 may be defined on door 18 along with a plurality of additional interior walls 74-80 forming icemaking compartment 70 in the door, including a back-facing wall 74, a top-facing wall 76, a bottom-facing wall 78 and a pair of side-facing walls 80. Additional components, e.g., one or more shelves 82, as well as additional storage bins or compartments, etc. may also be disposed on an interior wall of door 18, and further, as represented by door 84, one or more doors and/or removable panels may be defined on any of interior walls 74-80 to provide access to icemaking compartment 70. In the illustrated embodiment, for example, door 84 may provide access to an ice storage bin, bucket or other storage structure to enable a user to remove ice from the icemaking system and/or otherwise access the icemaking system for other purposes, e.g., to remove a blockage.

While exterior wall 68 and interior walls 74-80 are illustrated as defining a generally cuboid-shaped icemaking compartment 70, it will be appreciated that the invention is not so limited, as any number and/or arrangement of planar and/or curved surfaces may be used to define an icemaking compartment in other embodiments. Moreover, while interior walls 74-80 in some embodiments may form a housing that is separate from and mounted to door 18, in other embodiments interior walls 74-80 may be integrally formed with interior wall 72, e.g., as part of a single molded interior door panel. Furthermore, it will be appreciated that insulation, e.g., foam, may be incorporated into any and/or all of walls 68 and 72-80 to provide suitable insulation between icemaking compartment 70 (which is desirably maintained at a below-freezing temperature) and fresh food compartment 14 (which is desirably maintained at an above-freezing temperature, as well as between compartments 14, 70 and the exterior environment.

In addition, in the illustrated embodiment, door-mounted icemaking system 48 is a self-contained icemaking system, and as such includes a complete and closed refrigeration circuit (e.g., including at least a compressor, condenser and evaporator fluidly coupled to one another to circulate refrigerant) that is separate from the main refrigeration or cooling system 46 of refrigerator 10. In this regard, a water supply 86 and electrical supply 88 may be provided to door 18 to supply water and electrical power to icemaking system 48, and routed from cabinet 12 to door 18 in any number of suitable manners known to those of ordinary skill having the benefit of the instant disclosure (e.g., using water lines, electrical harnesses, etc.). It will also be appreciated that electrical supply 88 may solely provide a source of electrical power to icemaking system 48 in some embodiments, whereas in other embodiments, electrical supply 88 may communicate data, e.g., control signals, sensor signals, etc. between icemaking system 48 and electrical components within cabinet 12, e.g., controller 40. In other embodiments, however, portions of a refrigeration circuit may be disposed elsewhere in refrigerator 12, and as such, in some embodiments, one or more refrigerant lines may also be routed between door 18 and cabinet 12.

Figure 4:
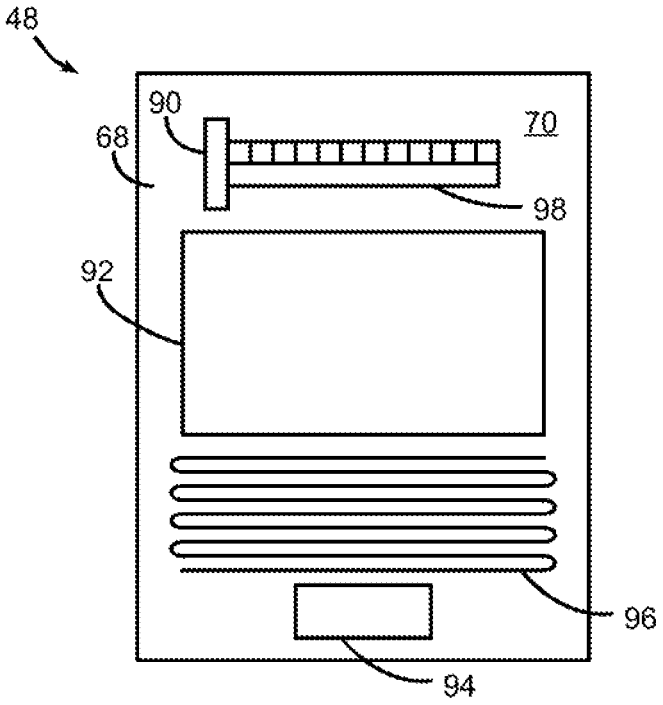
FIG. 4 is a functional cross-sectional diagram of the fresh food door of FIG. 3, taken along lines 4-4 thereof.
Figure 5:
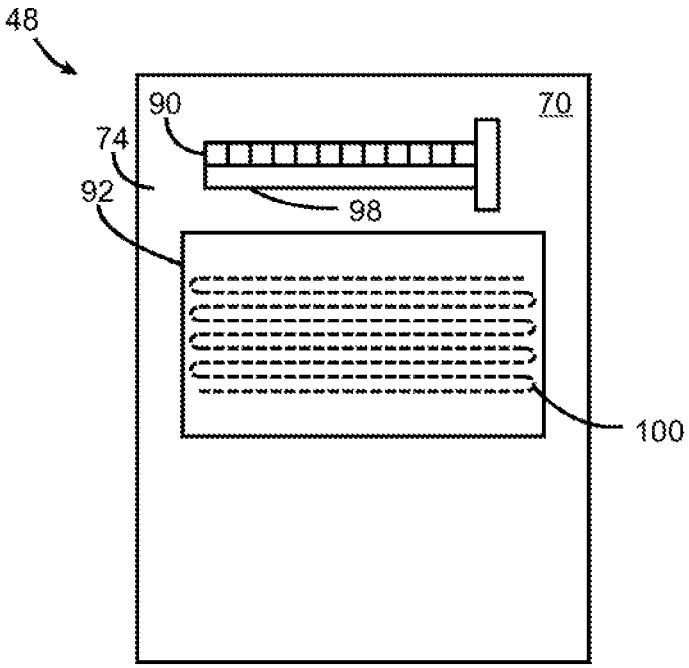
FIG. 5 is a functional cross-sectional diagram of the fresh food door of FIG. 3, taken along lines 5-5 thereof.

Now turning to FIGS. 4 and 5, these figures illustrate various components in an example implementation of icemaking system 48. FIG. 4, for example, is a view taken from within icemaking compartment 70 and toward exterior wall 68, while FIG. 5 is a view taken from within icemaking compartment 70 and toward interior wall 74.

As shown in these figures, icemaking system 48 may include an icemaking mold 90 and ice storage bin 92, each disposed between exterior wall 68 and the one or more interior walls 74-80 of door 18. Icemaking mold 90 generally includes a body having voids defined therein for receiving and freezing water into ice cubes of a particular size and shape, as well as additional icemaking components as will be apparent to those of ordinary skill having the benefit of the instant disclosure, e.g., a water valve, a shut-off or control arm, a heating element, a temperature sensor, etc. In some embodiments icemaking mold 90 may be pivotable, movable or otherwise configured to eject produced ice into ice storage bin 92.

Ice storage bin 92 is configured to receive and store ice produced by icemaking mold 90, and may be implemented using a fixed container, or alternatively, using a user-removable container that may be removed from icemaking compartment 70 to access the ice stored therein. Ice storage bin 92 may also include an ice mover such as an auger or conveyor, as well as an ice crusher, to enable ice to be conveyed to dispenser 24 for dispensing to a user through the front of door 18. In other embodiments, however, ice moving and crushing functionality may be implemented separate from ice storage bin 92, or may be omitted entirely (e.g., when no ice dispenser is provided in refrigerator 12.

Figure 6:
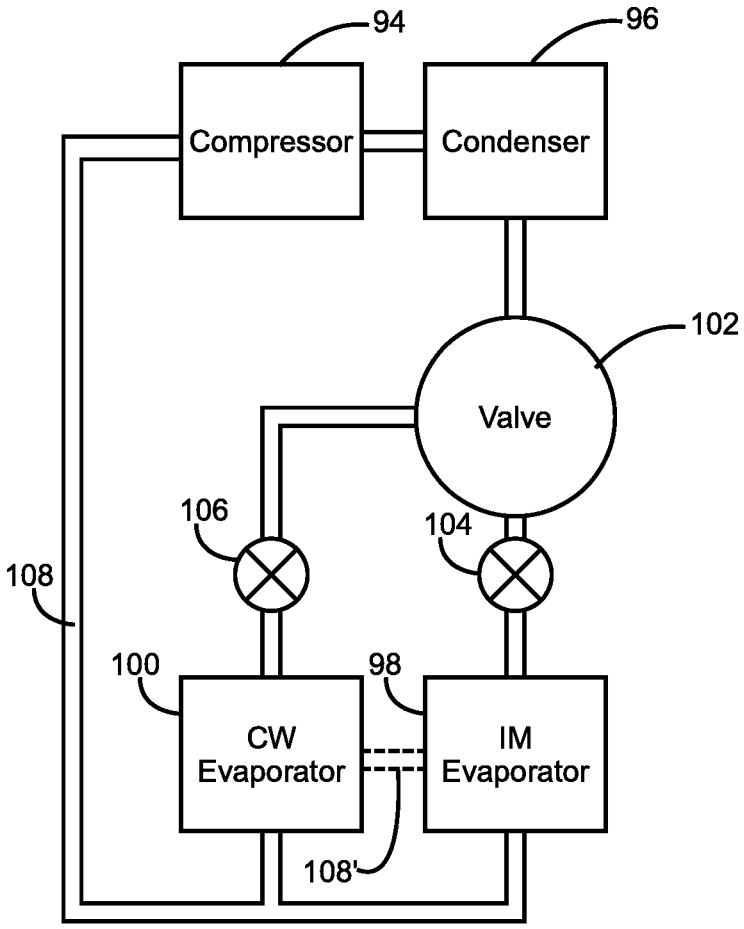
FIG. 6 is a block diagram of an example implementation of a refrigeration circuit for the door-mounted icemaking system of the refrigerator of FIG. 1.

With additional reference to FIG. 6, icemaking system 48 additionally includes an example implementation of a refrigeration circuit including a compressor 94, condenser 96, icemaking (IM) evaporator 98, cold wall (CW) evaporator 100, valve 102 and expansion devices 104, 106 coupled to one another using refrigerant lines 108.

Compressor 94 includes a high pressure output coupled to condenser 96, which is in turn coupled to valve 102 having two outputs respectively coupled through individual expansion devices 104, 106 to icemaking and cold wall evaporators 98, 100, such that compressor 94 and/or condenser 96 operate as a refrigerant supply for valve 102. Valve 102 may regulate refrigerant flow to one or both of evaporators 98, 100, and in the illustrated embodiment may be configured as a 2-way or 3-way valve to direct selective or proportional refrigerant flow to each of evaporators 98, 100. In some embodiments, it may be desirable to enable flow to individual evaporators to be individually turned on or shut off, while in other embodiments it may be desirable to enable refrigerant flow rates to be controlled for one or more of evaporators 98, 100. It will also be appreciated that while a single valve 102 is illustrated in FIG. 6, multiple valves may be used in some embodiments, e.g., with an individual valve for each evaporator 98, 100. Expansion devices 104, 106 may be configured in a number of different manners, e.g., as capillary tubes or mechanical or electronic expansion valves. Additional refrigeration circuit components, e.g., dryers, sensors, refrigerant dryers, accumulators, defrost heaters, are not shown, but would be apparent to those of ordinary skill in the art having the benefit of the instant disclosure.

An innumerable number of different variations of refrigeration circuit designs including one or more of these various components exist, and therefore the invention is not limited to the particular design illustrated herein. For example, in some embodiments, evaporators 98, 100 may be coupled in series, with no valves or other components providing selective control of one or both evaporators (as represented by alternate refrigerant line 108' extending between evaporators 98, 100). In some regards, evaporators 98, 100 may be considered in such embodiments to be two portions of the same overall evaporator component. In addition, in some embodiments, rather than utilizing an icemaking evaporator that is in thermal contact with an icemaking mold, another cold wall evaporator (or another portion of the same cold wall evaporator) may positioned to cool the icemaking mold. The additional cold wall evaporator may be coupled in series with cold wall evaporator 100 in some embodiments, and may not be separately controllable, while in other embodiments the two cold wall evaporators may be separately controllable.

Moreover, in some embodiments the refrigeration circuit of FIG. 6 may be configured as a reversible refrigeration circuit that is capable of reversing the flow of refrigerant to effectively operate one or both of evaporators 98, 100 as condensers, e.g., by running compressor 94 in reverse to reverse the flow of refrigerant through the circuit and controlling valve 102 to regulate the flow of refrigerant to either or both of evaporators 98, 100. In the illustrated embodiment, for example, it may be desirable to operate the refrigeration circuit to apply heat to icemaking mold 90 via icemaking evaporator 98 while inhibiting refrigerant flow to cold wall evaporator 100 to assist with releasing produced ice from the icemaking mold. Thus, in an ice producing mode, icemaking evaporator 98 may be configured to cool icemaking mold 90, and in an ice ejecting mode, icemaking evaporator 98 may be configured to heat icemaking mold 90. In other embodiments, however, no reversible refrigeration circuit may be used.

Returning to FIG. 5, icemaking evaporator 98 is disposed between exterior wall 68 and the one or more interior walls 74-80 of door 18 and is in thermal contact with icemaking mold 90 to directly cool the icemaking mold. In this regard, thermal contact refers to being in mechanical contact, either directly or indirectly through a thermally-conductive material (e.g., using one or more thermal shunts), with icemaking mold 90, such that heat is primarily transferred via conduction between icemaking mold 90 and icemaking evaporator 98, rather than through circulated cool air. In some embodiments, for example, icemaking evaporator 98 may be integrally formed within icemaking mold 90 such that refrigerant flows through lines formed within icemaking evaporator 98. In other embodiments, icemaking evaporator 98 may be directly mounted to icemaking mold 90, or otherwise placed in thermal contact with icemaking mold 90 in other manners that will be apparent to those of ordinary skill having the benefit of the instant disclosure. In still other embodiments, icemaking evaporator 98 may not be in thermal contact with icemaking mold 90, and moreover, in some embodiments icemaking evaporator 98 may be omitted entirely.

Cold wall evaporator 100 is provided in addition to or in lieu of icemaking evaporator 98, and is also disposed between exterior wall 68 and the one or more interior walls 74-80 of door 18. In particular, in the illustrated embodiment, cold wall evaporator 100 is disposed along back-facing interior wall 74 proximate ice storage bin 92, thereby providing cooling of ice stored in ice storage bin 92. Evaporator 100 is a cold wall evaporator insofar as the evaporator may be used to provide a cold wall or surface with which to cool the icemaking compartment 70. As such, in some embodiments evaporator 100 may be generally planar in shape and extend along at least a portion of one or more of interior walls 74-80. For example, evaporator 100 may be formed as an evaporator coil as illustrated in FIG. 5, although the invention is not so limited.

Returning to FIG. 4, compressor 94 and condenser 96 may also be disposed between exterior wall 68 and the one or more interior walls 74-80 of door 18, e.g., mounted to exterior wall 68 of door 18. Furthermore, given that both components emit heat, it may be desirable to position both components away from ice storage bin 92 and icemaking mold 90, and in some embodiments, to include an insulated partition or a separate, insulated compartment for the condenser and compressor in door 18. Condenser 96 may be configured in some embodiments as a hot wall condenser, and thus may be generally planar in shape to extend along at least a portion of exterior wall 68. In addition, condenser 96 may be formed as a condenser coil as illustrated in FIG. 4, although the invention is not so limited.

In addition, while not shown in FIG. 4, an ice chute and/or other ice and/or water dispenser components may be disposed proximate icemaking compartment 70 in some embodiments. Thus, the positions of compressor 94, condenser 96 and/or cold wall evaporator 100 may be dictated in some embodiments by the positioning of a dispenser in door 18.

Figure 7:
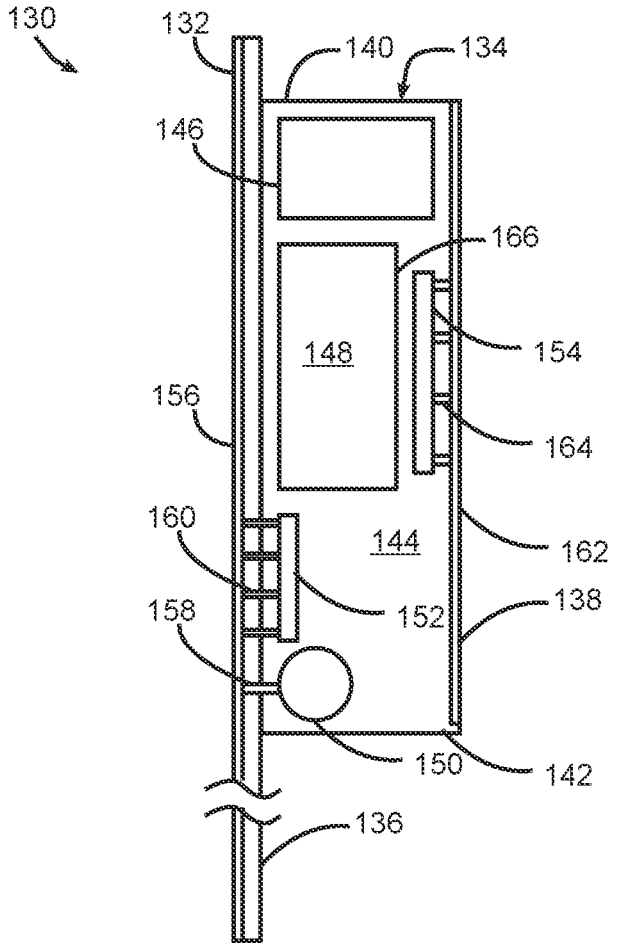
FIG. 7 is a functional side cross-sectional view of an alternate fresh food door to that illustrated in FIG. 3.

It will be appreciated that a number of techniques may be implemented in some embodiments to improve heat transfer for the purpose of more efficiently cooling icemaking compartment 70 and/or dissipating heat generated by compressor 94 and/or condenser 96. FIG. 7, for example, illustrates an alternate design for a fresh food compartment door 130, including an exterior wall 132 facing the exterior environment, as well as an icemaking compartment 134 defined by one or more interior walls facing a fresh food compartment when door 130 is closed. In the illustrated embodiment, for example, a main back-facing interior wall 136 may be defined on door 130 along with a plurality of additional interior walls 138-144 forming an icemaking compartment in the door, including a back-facing wall 138, a top-facing wall 140, a bottom-facing wall 142 and a pair of side-facing walls 144. Additional components, e.g., shelves, bins, an ice and/or water dispenser, etc., are omitted from FIG. 7 for clarity.

Icemaking system 134 includes an icemaking mold 146, ice storage bin 148, compressor 150, condenser 152 and evaporator 154. Compressor 150 and condenser 152 are disposed proximate exterior wall 132, and condenser 152 is configured as a generally planar condenser coil extending along at least a portion of exterior wall 132.

To enhance heat dissipation for compressor 150 and/or condenser 152, it may be desirable in some embodiments to include a thermally-conductive body in the exterior wall and in thermal contact with compressor 150 and/or condenser 152. In FIG. 7, for example, door 130 may include an exterior metal skin 156 similar to a conventional refrigerator, and it may be desirable to place compressor 150 and/or condenser 152 in thermal contact with exterior metal skin 156 such that heat may be dissipated over much of the exterior surface area of door 130. In some embodiments, for example, one or more heat shunts 158, 160 may extend between exterior metal skin 156 and compressor 150 and/or condenser 152 to thermally conduct heat from the compressor and/or condenser to exterior metal skin 156. It will be appreciated that a thermally-conductive body and/or heat shunt may be formed of metals and other heat conducting materials, and that various configurations of cooling bodies and heat shunts may be used to dissipate heat onto the exterior wall 132 of door 130. For example, various metal plates, panels, etc. may be used for a thermally-conductive body in some embodiments to effectively increase the surface area over which heat may be dissipated.

Similarly, to enhance the cooling efficiency of cold wall evaporator 154, it may be desirable to configure cold wall evaporator 154 as a generally planar evaporator coil disposed along at least a portion of back-facing wall 138. In addition, it may be desirable in some embodiments to include a thermally-conductive body formed of a heat conducting material and in thermal contact with the cold wall evaporator, and disposed on one or more interior walls of door 130, e.g., metal sheet 162 on back-facing wall 138. Metal sheet 162 may be in thermal contact with evaporator 154 through one or more heat shunts 164, or may be directly coupled thereto. Further, in some embodiments, one or more fans may be used to improve convection and create improved coolness performance of cold wall evaporator 154. As shown in FIG. 7, at least a portion of evaporator 154 may be positioned between back-facing wall 138 and a sidewall 166 of ice storage bin 148.

It will be appreciated that a thermally-conductive body may be disposed on a wall in a number of fashions, e.g., by forming the wall of a thermally-conductive material, or by embedding, laminating, fastening, or otherwise attaching thermally-conductive material to a wall.

Figure 8:
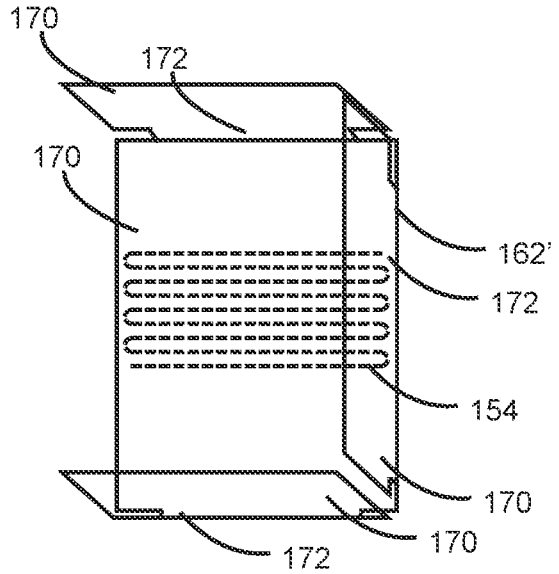
FIG. 8 is a functional perspective view of an alternate cold wall evaporator to that illustrated in FIG. 7.

Moreover, in some embodiments, a thermally-conductive body may be formed on multiple walls and/or multiple thermally-conductive bodies may be provided on one or more walls. FIG. 8, for example, illustrates an alternate thermally-conductive body 162' suitable for use with cold wall evaporator 154 and including multiple panels or portions 170 configured to be disposed on interior walls 138, 140, 142 and 144 of door 130 (FIG. 7) and joined together along folds 172. FIG. 8 also illustrates that in some embodiments, evaporator 154 may be directly coupled to thermally-conductive body 162', rather than coupled through heat shunts as is illustrated in FIG. 7. In still other embodiments, a cold wall evaporator may itself include multiple portions that extend along multiple interior walls of a door. Other manners of increasing the effective surface area of a cold wall evaporator may be used in other embodiments.

Returning to FIG. 6, as discussed above a controller may be coupled to an icemaking system to control the production of ice as well as regulate the temperature within an icemaking compartment. A controller may therefore be coupled to, for example, icemaking mold 90 (FIGS. 4-5) as well as compressor 94 and valve 102 to regulate refrigerant flow to one or both of the icemaking and cold wall evaporators 98, 100. In some embodiments, for example, a controller may be configured to regulate refrigerant flow to effectively activate only one of the icemaking and cold wall evaporators 98, 100 in particular circumstances.

For example, when it is determined that the ice storage bin is full (e.g., using a level sensor), generally ice production will be halted to prevent over filling, so a controller may reduce or even shut off refrigerant flow to icemaking evaporator 98 since no ice production is needed in the immediate future. In addition, when storing ice, generally minimal cooling is required, so refrigerant flow to cold wall evaporator 100 may also be restricted to provide limited cooling.

As another example, when all of the ice storage has been depleted quickly, the depletion may be indicative of a high usage condition (e.g., a party) where maximum ice production is desired. Thus, a controller in some embodiments may detect such high usage (e.g., based upon sensing an empty ice storage bin, sensing higher than normal usage of an ice dispenser, etc.) and reduce or even shut off refrigerant flow to cold wall evaporator 100 and/or focus maximum cooling capacity toward icemaking evaporator 98 since maintaining ice storage temperature is a lower priority than producing ice over the short term (since chances are high that any new ice introduced to the ice storage bin will be dispensed quickly).

A controller may also in some embodiments employ a more balanced allocation of cooling capacity between evaporators 98, 100, e.g., during normal usage, where ice may be produced as needed (e.g., based on a level sensor), and cooling of the ice storage bin may be performed to prevent melting. A controller may therefore alternate between the two evaporators, or provide a percentage cooling to both, to appropriately balance ice production and cooling of the ice in the ice storage bin.

In addition, as discussed above, a reversible refrigeration circuit may be used in some embodiments to assist with ejecting ice from an icemaking mold. Thus, in some embodiments a controller may selectively reverse a reversible refrigerator circuit to heat the icemaking mold when ejecting ice from the icemaking mold (e.g., by heating the mold immediately prior to and/or concurrently with physically ejecting the ice from the mold).

Figure 9:
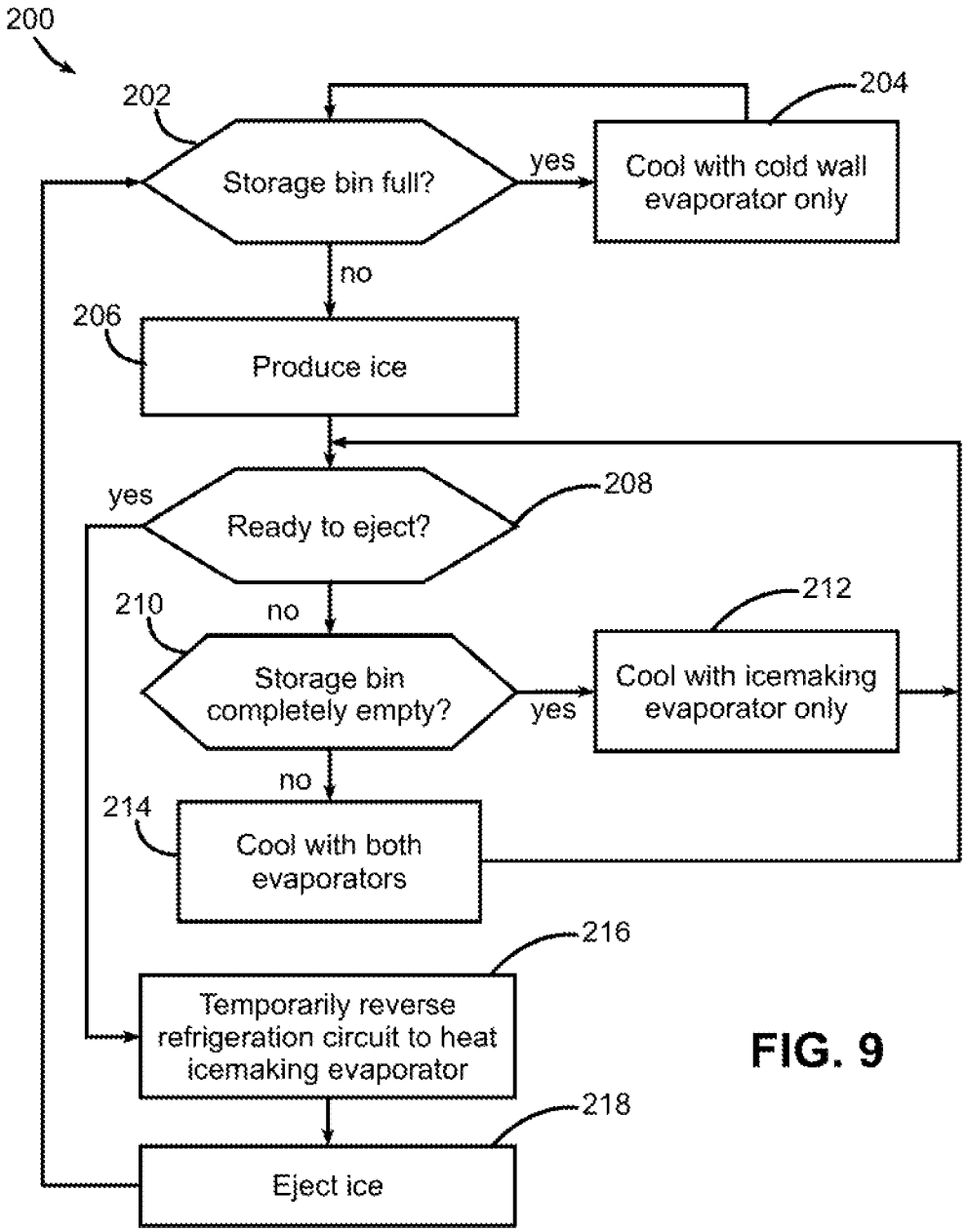
FIG. 9 is a flowchart illustrating an example sequence of operations for producing and storing ice in the refrigerator of FIG. 1.

FIG. 9, for example, illustrates an example sequence of operations 200 for operating icemaking system 48 with controller 40 consistent with some embodiments of the invention. Block 202, for example, may determine whether ice storage bin 92 is full (e.g., based on a level sensor). If so, no additional ice production is desired, so control may pass to block 204 to shut off refrigerant flow to icemaking evaporator 98 and direct refrigerant flow only to the cold wall evaporator 100. In some embodiments, a temperature sensor may also be used such that a temperature within icemaking compartment 70 may be controlled through one or more of cycling compressor 94 and regulating refrigerant flow to cold wall evaporator 100 with valve 102.

If the ice storage bin is not full, however, additional ice production may be initiated, and control may pass from block 202 to block 206 to start an ice production operation (e.g., by filling icemaking mold 90 with water). Block 208 then determines if the ice production operation is complete and the ice produced thereby is ready to be ejected. If not, control passes to block 210 to determine whether ice storage bin 92 is completely empty. If so (which may be indicative of higher than usual ice consumption and thus a need for maximum ice production), control passes to block 212 to cool with icemaking evaporator 98 only, e.g., by shutting off refrigerant flow to cold wall evaporator 100 and directing full refrigerant flow to icemaking evaporator 98. Control then returns to block 208 to wait until icemaking mold 90 is ready to eject the ice.

Returning to block 210, if the ice storage bin is not completely empty, it may be desirable to employ a more balanced cooling scheme, and thus control may pass to block 214 to meter or cycle refrigerant flow between both evaporators 98, 100, thereby balancing ice production with maintaining an adequate temperature in the ice storage bin. Control then returns to block 208.

Once icemaking mold 90 is ready to eject ice, block 208 passes control to block 216 to temporarily reverse the refrigeration circuit for a brief period of time, optionally directing all refrigerant flow to icemaking evaporator 98 to heat icemaking mold 90 to assist with ejecting the ice. Once the icemaking mold is sufficiently heated, control passes to block 218 to eject the ice from icemaking mold 90, and control then returns to block 202 to produce additional ice if necessary.

It will be appreciated that various additional modifications may be made to the embodiments discussed herein, and that a number of the concepts disclosed herein may be used in combination with one another or may be used separately. For example, a cold wall evaporator as disclosed herein may be used in connection with an icemaking evaporator in some embodiments, or may be used without an icemaking evaporator. In some embodiments where a cold wall evaporator is used with an icemaking evaporator, the two evaporators may be separately controllable, while in other embodiments, the two evaporators may be collectively controlled. Further, in some embodiments, a cold wall evaporator may be used in connection with a hot wall condenser, while in other embodiments, each of a cold wall evaporator and a hot wall condenser may be used without the other. Moreover, in some embodiments, the herein-described cold wall evaporator and/or hot wall evaporator may be used in a self-contained door-mounted icemaking system, while in other embodiments, portions of a refrigeration circuit may be disposed in a refrigerator cabinet rather than within a door. In addition, in some embodiments a reversible refrigeration circuit may be used in connection with other types of icemaking systems, e.g., including other evaporators and/or condensers from those described herein. Further, while no ducting, fans or other air circulation is used in connection with the herein-described door-mounted icemaking systems, in other embodiments cooling air may be circulated to provide at least a portion of the cooling employed in a door-mounted icemaking system consistent with the invention.

Other modifications will be apparent to those of ordinary skill in the art having the benefit of the instant disclosure. Therefore, the invention lies in the claims hereinafter appended.

What is claimed is:

1. A door-mounted icemaking system for a refrigerator, the refrigerator of the type including a cabinet including one or more food storage compartments defined therein and a door coupled to the cabinet adjacent an opening of a first compartment from among the one or more food storage compartments and configured to insulate the first compartment from an exterior environment, the door including one or more interior walls facing the first compartment when the door is closed and an exterior wall facing the exterior environment, the door-mounted icemaking system including:

an icemaking mold disposed between the exterior wall and the one or more interior walls of the door and configured to produce ice;

an ice storage bin disposed between the exterior wall and the one or more interior walls of the door and configured to receive and store ice produced by the icemaking mold, the ice storage bin including a substantially vertical sidewall extending along at least one interior wall among the one or more interior walls of the door;

an icemaking evaporator disposed between the exterior wall and the one or more interior walls of the door and in thermal contact with the icemaking mold to directly cool the icemaking mold;

a fanless cold wall evaporator substantially vertically disposed adjacent the ice storage bin and having at least a portion thereof that is positioned between the sidewall of the ice storage bin and the at least one interior wall; and at least one valve coupled between a refrigerant supply and one or both of the icemaking and cold wall evaporators and configured to regulate refrigerant flow to one or both of the icemaking and cold wall evaporators.

2. A refrigerator, comprising:

a cabinet including one or more food storage compartments defined therein;

a door coupled to the cabinet adjacent an opening of a first compartment from among the one or more food storage compartments and configured to insulate the first compartment from an exterior environment, the door including one or more interior walls facing the first compartment when the door is closed and an exterior wall facing the exterior environment; and a door-mounted icemaking system disposed on the door, the door-mounted icemaking system including:

an icemaking mold disposed between the exterior wall and the one or more interior walls of the door and configured to produce ice;

an ice storage bin disposed between the exterior wall and the one or more interior walls of the door and configured to receive and store ice produced by the icemaking mold, the ice storage bin including a substantially vertical sidewall extending along at least one interior wall among the one or more interior walls of the door; and a fanless cold wall evaporator substantially vertically disposed adjacent the ice storage bin and having at least a portion thereof that is positioned between the sidewall of the ice storage bin and the at least one interior wall.

3. The refrigerator of claim 2, wherein the cold wall evaporator includes a generally planar evaporator coil disposed along at least a portion of a first interior wall among the one or more interior walls of the door.

4. The refrigerator of claim 2, wherein the cold wall evaporator extends along multiple interior walls among the one or more interior walls of the door, wherein the multiple interior walls include interior walls selected from the group consisting of a back-facing wall, a top-facing wall, a bottom-facing wall, and a side-facing wall.

5. The refrigerator of claim 2, further comprising a thermally-conductive body disposed on the at least one interior wall, the thermally-conductive body formed of a heat conducting material and in thermal contact with the cold wall evaporator.

6. The refrigerator of claim 5, wherein the thermally-conductive body comprises a metal sheet, wherein the metal sheet includes multiple portions disposed on multiple interior walls among the one or more interior walls of the door.

7. The refrigerator of claim 2, further comprising an icemaking evaporator in thermal contact with the icemaking mold to directly cool the icemaking mold.

8. The refrigerator of claim 7, wherein the icemaking evaporator is integrally formed with the icemaking mold, and wherein the icemaking and cold wall evaporators are coupled in series.

9. The refrigerator of claim 7, further comprising:

at least one valve disposed between a refrigerant supply and one or both of the icemaking and cold wall evaporators to regulate refrigerant flow to one or both of the icemaking and cold wall evaporators; and a controller coupled to the at least one valve, the controller configured to control the at least one valve to direct refrigerant flow only to the cold wall evaporator when the ice storage bin is full, and direct refrigerant flow only to the icemaking evaporator when maximizing ice production.

10. The refrigerator of claim 7, wherein the door-mounted icemaking system further includes a reversible refrigeration circuit coupled to the icemaking evaporator, the reversible refrigeration circuit configured to cool the icemaking mold when operating in an ice producing mode and to heat the icemaking mold when operating in an ice ejecting mode.

11. The refrigerator of claim 2, wherein the door-mounted icemaking system further includes a condenser disposed between the exterior wall and the one or more interior walls of the door, wherein the condenser includes a generally planar condenser coil extending along at least a portion of the exterior wall of the door.

12. The refrigerator of claim 11, further comprising a thermally-conductive body disposed in the exterior wall, the thermally-conductive body formed of a heat conducting material and in thermal contact with the condenser, wherein the thermally-conductive body comprises an exterior metal skin of the door.

13. The refrigerator of claim 11, wherein the door-mounted icemaking system further includes a compressor disposed between the exterior wall and the one or more interior walls of the door and operatively coupled to the cold wall evaporator and the condenser in a self-contained in-door refrigeration circuit.

14. The refrigerator of claim 13, further comprising a thermally-conductive body disposed in the exterior wall of the door, the thermally-conductive body formed of a heat conducting material and in thermal contact with the condenser and the compressor.

15. A refrigerator, comprising:

a cabinet including one or more food storage compartments defined therein;

a door coupled to the cabinet adjacent an opening of a first compartment from among the one or more food storage compartments and configured to insulate the first compartment from an exterior environment, the door including one or more interior walls facing the first compartment when the door is closed and an exterior wall facing the exterior environment, wherein the exterior wall of the door includes an exterior metal skin;

a door-mounted icemaking system disposed on the door, the door-mounted icemaking system including:

an icemaking mold disposed between the exterior wall and the one or more interior walls of the door and configured to produce ice;

an ice storage bin disposed between the exterior wall and the one or more interior walls of the door and configured to receive and store ice produced by the icemaking mold; and a fanless refrigeration circuit disposed on the door and including an evaporator disposed between the exterior wall and the one or more interior walls of the door and configured to provide cooling for the door-mounted icemaking system and a hot wall condenser disposed on the door and in fluid communication with the evaporator, wherein the hot wall condenser is configured to dissipate heat generated by the refrigeration circuit through the exterior wall of the door, and wherein the condenser is in thermal contact with the exterior metal skin of the door; and a plurality of heat shunts extending between the condenser and the exterior metal skin of the door.

16. The refrigerator of claim 15, wherein the hot wall condenser includes a generally planar condenser coil extending along at least a portion of the exterior wall of the door.

17. The refrigerator of claim 15, further comprising a thermally-conductive body disposed in the exterior wall, the thermally-conductive body formed of a heat conducting material and in thermal contact with the condenser.

18. The refrigerator of claim 15, wherein the door-mounted icemaking system further includes a compressor disposed between the exterior wall and the one or more interior walls of the door and operatively coupled to the evaporator and the condenser in a self-contained in-door refrigeration circuit, and wherein the refrigerator further comprises a thermally-conductive body disposed in the exterior wall of the door, the thermally-conductive body formed of a heat conducting material and in thermal contact with the condenser and the compressor.

* * * * *